United States Patent [19]

Hoedl et al.

[11] 4,340,360

[45] Jul. 20, 1982

[54] FIRE BRICK FOR A ROTARY KILN

[75] Inventors: Fritz Hoedl, Vienna, Austria; Morihiro Kimura, Tokyo; Yoshio Yasuda, Bizen, both of Japan

[73] Assignees: Veitscher Magnesitwerke-Aktiengesellschaft, Vienna, Austria; Shinagawa Refractories Co., Ltd., Tokyo, Japan

[21] Appl. No.: 217,536

[22] Filed: Dec. 17, 1980

[30] Foreign Application Priority Data

Jun. 19, 1980 [JP] Japan ..... 55-84968[U]

[51] Int. Cl.[3] ..... F27B 7/28

[52] U.S. Cl. ..... 432/119; 432/118; 52/605

[58] Field of Search ..... 432/118, 119; 110/338, 110/340; 52/598, 612, 603–605

[56] References Cited

U.S. PATENT DOCUMENTS

| | | | |
|---|---|---|---|
| 2,230,142 | 1/1941 | Longacre | 432/119 |
| 2,462,289 | 2/1949 | Rochow | 52/605 |
| 2,622,864 | 12/1952 | Hasche | 52/605 |
| 2,635,865 | 4/1953 | Brumbaugh | 432/119 |
| 2,694,565 | 11/1954 | Sainderichin | 432/118 |
| 2,829,877 | 4/1958 | Davis, Jr. | 432/119 |
| 3,330,546 | 7/1967 | Bryan | 432/119 |
| 3,343,824 | 9/1967 | Schneider | 432/119 |
| 3,471,136 | 10/1969 | Hodl | 432/119 |

FOREIGN PATENT DOCUMENTS

| | | | |
|---|---|---|---|
| 1195593 | 11/1959 | France | 432/118 |

*Primary Examiner*—Henry C. Yuen

*Attorney, Agent, or Firm*—Wenderoth, Lind & Ponack

[57] ABSTRACT

The present invention relates to a fire brick for a rotary kiln, provided on one or both large surface area portions with at least one concavity extending in the radial direction of the kiln, and opening on at least the face.

The present invention further relates to a fire brick for a rotary kiln as described above, further provided with a steel plate having a concavity of dimensions which the sum of the depth of the concavity of said brick plus an expansion absorbing tolerance, and applied to a maximum surface area and lying over the concavity.

The present invention still further relates to a fire brick for a rotary kiln as described above, further provided with board or asbestos, etc., on the face end of the steel plate.

2 Claims, 10 Drawing Figures

FIRE BRICK FOR A ROTARY KILN

BACKGROUND OF THE INVENTION

This invention relates to fire bricks used in rotary furnaces such as rotary cement kilns, and in particular relates to the form and construction thereof.

By providing concavities in a maximum surface area portion of a fire brick and striving for the early application and stabilization of the application of a coating, the fire bricks are protected, and the heat insulation effect is raised by the coating, whereby the durabillity of the fire bricks during use is improved and heat dispersion is reduced, or, in other words, a contribution is made to energy saving.

In rotary furnaces, chiefly rotary cement kilns, a device which uses a lot of energy, in view of the recent oil situation, particular attention is being paid to countermeasures to achieve energy savings.

Cement calcination furnaces have changed from vertical kilns to rotary furnaces, and the development of the technology thereof has been unprecedently spectacular, moving through the wet type, the semi-dry type and the dry type to the new dry type with preheaters, and recently to the NSP type provided with a preheater and an auxiliary furnace. As is generally known, by this progress the amount of fuel for one ton of cement clinker has been substantially reduced from 120 l/t to 80 l/t or less. However, even though such a reduction in fuel costs accompanying the development of equipment technology has been achieved, the recent energy situation makes further steps for energy saving very desirable. However the development of equipment technology is regarded as having reached its peak with the completion of the NSP system, and there is little room for improvement beyond it.

Heat input and output in a current NSP type kiln are as shown in the following table.

TABLE 1

Kiln total system heat accounting, results
(According to the type of kiln, average values)*
Units: $10^3$ Kcal/Clinker ton
( ): Proportion (%)

| | | Kiln type | |
|---|---|---|---|
| | | SP Kiln | NSP Kiln |
| Input | Heat from burning heavy oil | 814.8 (97.3) | 790.1 (97.2) |
| | Others | 23.0 (2.7) | 22.6 (2.8) |
| | Input Heat Total | 837.8 (100.0) | 812.7 (100.0) |
| Output | Heat used in clinker calcination | 417.5 (49.8) | 423.5 (52.1) |
| | Preheater exhaust gas heat | 175.8 (21.0) | 165.4 (20.4) |
| | Heat taken off with the clinker | 21.6 (2.6) | 19.9 (2.4) |
| | Cooler exhaust gas heat | 111.5 (13.3) | 129.5 (15.9) |
| | Heat losses to radiation, etc. | 98.0 (11.7) | 63.8 (7.9) |
| | Others | 13.3 (1.6) | 10.5 (1.3) |
| | Output Heat Total | 837.8 (100.0) | 812.6 (100.0) |

*From Report T-12 of the Fuel Specialist Committee of the Cement Association, P.78 "A Survey with regard to SP Kilns" January, 1976.

Table 1 illustrates how important it is to reduce the amount of radiated heat.

This quantity of radiated heat consists mainly of that from the rotary kiln itself. That is to say, in order to save energy with these rotary furnaces some heat insulation countermeasures to reduce heat losses from the iron cladding of the rotary kiln are indispensable.

In rotary cement kilns, etc., there are cases of heat resistant fire bricks being used, but these are all chiefly in the low temperature range, and from the point of view of durability during use, such bricks are inferior to conventional fire bricks. Other than this, there is the two layer cladding method of disposing fire bricks with a low coefficient of heat transmission over the iron cladding, but "misalignment" with the inner bricks during use produces loosening and induces falling out, so this has seldom been used with large diameter kilns. Also, in the high temperature calcination zone, there have been used the so-called clog-bricks in which concavities are provided in the back of the bricks and in which a refractory heat barrier material is applied thereto, and two layer bricks in which the iron cladding of the fire bricks is in a material with a low heat transmission coefficient. However, they all lack strength and so are not suitable for long term operation.

Cement clinker adheres to the refractory material used in the calcination zone of a rotary cement kiln, and a coating is formed, and since the heat transmission coefficient of this coating is substantially lower than that of the fire bricks themselves a heat insulation effect is obtained, and the temperature of the fire bricks is lowered. Accordingly, the coating can be said to serve two purposes, namely saving energy and protecting the bricks.

The relationship between the coating thickness and iron cladding surface temperature in a rotary cement kiln is as follows.

TABLE 2

Relationship between Iron Cladding Surface Temperature and Coating Thickness*
Preconditions:
Bricks: Quality: High Temperature Calcinated Basic Bricks, Thickness 200 mm
Iron Cladding: Thickness 40 mm, Inside Diameter 5,000 mm, Blackness of the iron cladding = 0.85
Coating Inner Wall Surface Temperature: 1450° C.
External Air Temperature: 20° C. (No Wind)
Heat Transmission Coefficient (Kcal/m.h. °C.)
Bricks = 2.35 Coating = 1.0

| Iron Cladding Temperature | Coating Thickness |
|---|---|
| 100° C. | 864 mm |
| 130 | 576 |
| 160 | 396 |
| 190 | 278 |
| 220 | 195 |
| 250 | 136 |
| 280 | 92 |
| 310 | 58 |
| 340 | 32 |
| 370 | 11 |

*From Report T-10 of the Fuel Specialist Committee of the Cement Association, P.46 "A Survey Relating to Refractory Materials for Use in Rotary Kilns" March 1972.

SUMMARY OF THE INVENTION

The present invention relates to a fire brick for a rotary kiln, provided on one or both large side surface area portions with at least one concavity extending in the radial direction of the kiln, and opening in at least the face end of the brick.

The present invention further relates to a fire brick for a rotary kiln as described above, further provided with a steel plate having a concavity with dimensions which are the sum of the depth of the concavity of said brick plus an expansion absorbing tolerance, said steel plate being applied to said large side surface area and lying over the concavity in the brick.

The present invention still further relates to a fire brick for a rotary kiln as described above, further provided with board or asbestos, or the like, on the face end of the steel plate.

The present invention has as its object the provision of a brick for use in a fire brick lining in a rotary kiln, said brick having a shape and construction whereby a coating can be relatively easily and stably adhered thereto.

Heretofore the shapes of bricks used in rotary kilns have been an arch shape, a wedge shape and a circular shape, according to JIS. In the present invention, adjacent bricks of these shapes are in contact, and one or more concavities are provided on one or both contacting surfaces, which are the large side surface area portions of the bricks, and the concavities extend in the radial direction in the kiln so as to open in at least the face of the brick, i.e. the surface facing the interior of the kiln. When concavities are provided on both surfaces, adjacent bricks are provided with twin concavities. The concavities may extend from the face clear across the side surface to the iron cladding end of the brick, or they may terminate part way thereacross. The purpose of these concavities is to make contact area between the fire bricks and the material to be calcined (clinker) as large as possible within a range where the durability of bricks is not impaired, and by forming a continuous coating in the interior of the concavities of the bricks, the coating is strongly adhered, and so becomes less likely to fall off. As a result it is possible to improve the heat insulation effect and the durability of the bricks.

With the prior shapes, even when a coating adhered to the bricks it lacked stability and was easily dislodged by heat impact, as a result of which the bricks were subject to a sudden temperature rise which was a major cause of damage, and, at the same time, of greater heat losses. The shape and number of the concavities are determined by the properties of the material to be calcined and the material used for the fire bricks and its form, and they must have a configuration whereby the inside of the concavities will be filled by the coating. If they are adequately filled, a strong coating will be formed on the heating surface and in the concavities by reaction with the bricks during use, and the desired objects will be achieved.

DETAILED DESCRIPTION OF THE FIGURES

Figure 1:
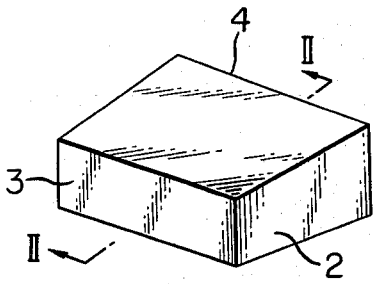
FIG. 1 is a perspective view showing the shape of a prior art brick.
Figure 2:
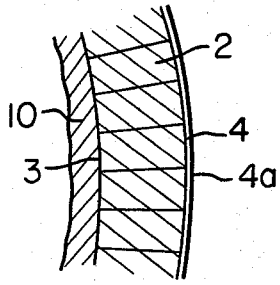
FIG. 2 is a sectional view along the line II—II in FIG. 1 and showing the bricks in a kiln.

FIG. 1 shows a prior art brick 2 having a face 3, i.e. the surface of the brick 2 which is to the inside of the furnace, and reference numeral 4 designates the iron cladding surface end. FIG. 2 shows a portion of a kiln using the bricks of FIG. 1, showing the coating 10 formed from the reaction of the brick with the clinker being calcined in the furnace.

Figure 3:
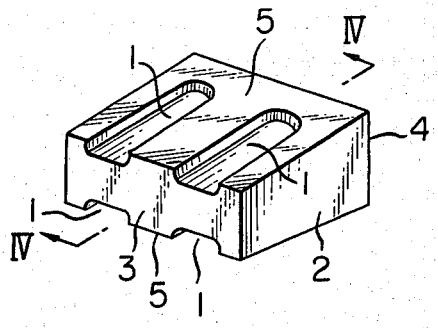
FIG. 3 is a perspective view showing one embodiment of a brick according to the present invention.
Figure 5:
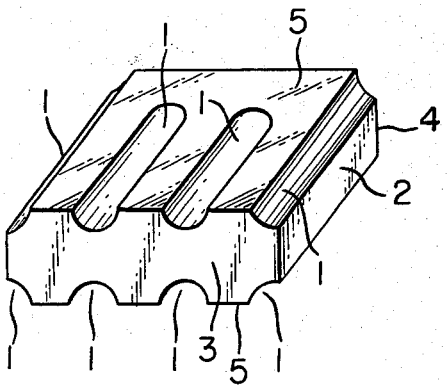
FIG. 5 and FIG. 6 are perspective views showing other embodiments of a brick according to the present invention.
Figure 6:
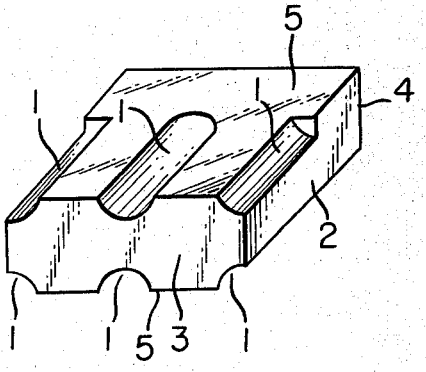

The brick of the present invention is characterised, as shown in FIG. 3, by the provision on one or both (in FIG. 3, both) of the large side surface 5 extending between the face 3 and iron cladding surface end 4, of at least one (in FIG. 3, two) concavities. Concavities 1 open in the face 3, and, when the brick is in position in the kiln, extend in the radial direction of the kiln and terminate before reaching iron cladding surface end 4, but they may pass completely thereacross (FIG. 5). The number and position of the concavities may be selected as appropriate as shown in FIGS. 5 and 6.

Figure 4:
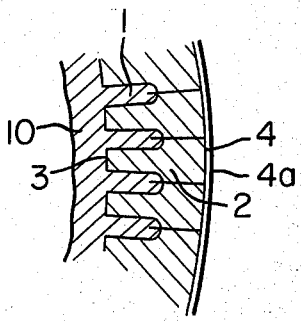
FIG. 4 is a sectional view along the line IV—IV in FIG. 3 and showing the bricks in a rotary kiln.
Figure 7:
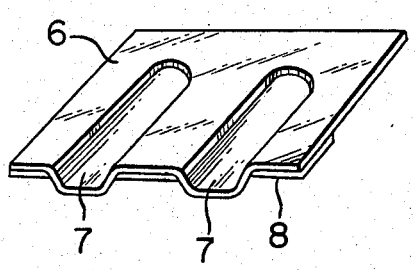
FIG. 7 is a perspective view showing a steel plate used between the bricks.
Figure 8:
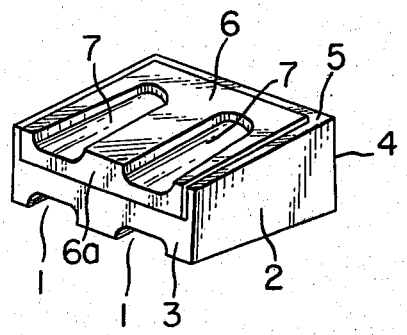
FIG. 8 is a perspective view showing another embodiment of a steel plate combined with a brick.

Between the individual basic bricks (magnesia, chromium, magnesia spinel) used in the calcination zone of rotary cement kilns, rotary limekilns, etc. steel plates are inserted as a joint material. These fulfill the function of absorbing expansion by utilizing the creep characteristics of steel plates at high temperatures, and function as a kind of "adhesive", the steel plates reacting with components in the bricks to form low-fusibility minerals, and have the function of turning the assembled bricks into a single unitary construction. In addition, in rotary cement kilns the steel plates react with the clinker to produce low fusibility materials, which forms a coating 10 is shown in FIGS. 2 and 4. Accordingly, this invention can achieve its effects with much more certainty by providing steel plates 6 which are cut away to coincide with the concavities 1 in bricks 2 or, as shown in FIG. 7, provided with depressions 7 shaped to conform to the concavities. Also, the effect is further increased if, as shown in FIG. 8, the portion **6*a* of the steel plate 6** used between the bricks extends to the face.

The above assumes that, as shown in FIG. 4, the concavities will be filled with the material to be calcined, such as clinker, during use, and that the coating 10 will be formed. However, it is also possible to pre-fill the concavities with a material that will accelerate the adhesion of a coating 10. This filler may be a material which is an intermediate component of the reaction material between material to be calcined and the lining bricks, and, in order to increase its corrosion resistance, a chromium oxide, or, in order to facilitate the attaching of the coating, a sulfide of an iron oxide or an alkali earth metal, and a carbonate, may be added.

Figure 9:
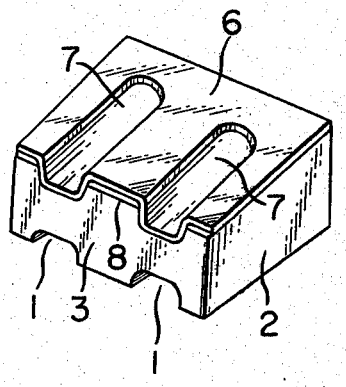
FIG. 9 is a perspective view showing board or abestos between the steel plate and the brick.
Figure 10:
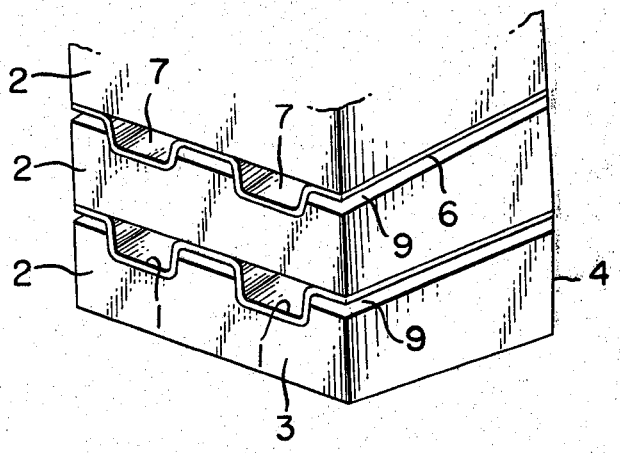
FIG. 10 is a perspective view showing an assembly of some steel plates and bricks.

By paying attention to the following points in the assembly of the fire bricks 2 having concavities 1 and the steel plates 6 having depressions 7 which correspond to the concavities, it is possible to provide an expansion absorbing tolerance. As shown in FIG. 10, the steel plate 6 is not adhered closely to the whole surface of the brick 2 having concavities 1, and the depth of depressions 7 in the steel plate 6 is the sum of the depth of concavities 1 of brick 2 and expansion absorbing tolerance. Initially the steel plate 6 has the bottom portion of depressions 7 supported by the bottom of concavities 1 of brick 2, and the other portions are suspended above the surface 5 a distance corresponding to the expansion absorbing tolerance component, and support the adjacent brick. In this case, however, in order to prevent the material to be calcined from entering the spaces 9 from the face, and impairing the expansion tolerance effect, it is desirable that a material 8 such as board or asbestos, and the which are commonly used as expansion absorption materials, be preadhered, as in FIGS. 7 and 9, to the face end of the steel plate.

By means of the present invention the following effects are obtained.

(1) Compared with prior shapes, the coating adheres earlier and there is little peeling off after adhesion, so the coating's heat insulation properties can be more effectively used, and it is possible to reduce the fuel consumption in the kiln.

(2) The stable adhesion of the coating fulfills the function of protecting the fire bricks lining the rotary kiln, and moderates the damage due to heat impact and chemical erosion, whereby much longer operation is made possible, and the consumption of bricks is reudced.

(3) It is possible to save refractory raw material by an amount corresponding to the concavity portions, and so there is a saving of resources. Also, because of the weight reduction, efficiency of kiln operation is improved.

What is claimed is:

1. A fire brick for a rotary kiln, said brick having a face which, when the brick is installed in a rotary kiln, faces the interior of the kiln, a pair of opposite large side surfaces extending away from said face, and an iron cladding end to which said large side surfaces extend and, when the brick is installed in a rotary kiln, engages the iron cladding of the kiln, at least one of said side surfaces having at least one concavity extending in the radial direction of the kiln from said face, and a steel plate covering said side surface and having a portion complementary in shape to said concavity and extending to the bottom of said concavity, said steel plate being bent to form a concavity complementary in shape to the concavity in said brick, the concavity in said plate being the sum of the depth of the concavity in said brick plus an expansion absorbing tolerance.

2. A fire brick as claimed in claim 1 further comprising an expansion absorbing material between said side surface of said brick over which said steel plate is positioned and the steel plate and filling the space between said side surface of the brick and the steel plate at said face of said brick.

* * * * *